US005189473A

United States Patent [19]

Negoro et al.

[11] Patent Number: 5,189,473

[45] Date of Patent: Feb. 23, 1993

[54] INSIDE CONTAMINATION PREVENTION STRUCTURE FOR A DEVICE UTILIZING TONER PARTICLES

[75] Inventors: Ikuo Negoro, Sakado; Hiroyuki Yamaguchi; Masahiro Kita, both of Tokyo, all of Japan

[73] Assignee: Asahi Kogaku Kogyo Kabushiki Kaisha, Tokyo, Japan

[21] Appl. No.: 682,937

[22] Filed: Apr. 10, 1991

[30] Foreign Application Priority Data

Apr. 10, 1990 [JP] Japan ..... 2-38268[U]

[51] Int. Cl.[5] ..... G03G 21/00

[52] U.S. Cl. ..... 355/215; 355/245; 355/296

[58] Field of Search ..... 355/215, 245, 250, 251, 355/296, 298, 299, 301

[56] References Cited

U.S. PATENT DOCUMENTS

| | | |
|---|---|---|
| 3,332,328 | 7/1967 | Roth . |
| 3,909,864 | 10/1975 | Tanaka et al. . |
| 3,914,046 | 10/1975 | Tanaka et al. . |
| 4,154,521 | 5/1979 | Tanaka et al. . |
| 4,213,794 | 7/1980 | Wooding et al. . |
| 4,459,012 | 7/1984 | Allen et al. . |
| 4,483,606 | 11/1984 | Kuwako et al. . |
| 4,571,056 | 2/1986 | Tani et al. . |
| 4,666,282 | 5/1987 | Rowe . |
| 4,693,588 | 9/1987 | Yarbrough et al. . |

FOREIGN PATENT DOCUMENTS

| | | | |
|---|---|---|---|
| 0100246 | 2/1984 | European Pat. Off. | 355/215 |
| 0257907 | 3/1988 | European Pat. Off. | 355/215 |
| 63-61278 | 3/1988 | Japan | 355/215 |

*Primary Examiner*—Richard L. Moses

*Attorney, Agent, or Firm*—Sandler, Greenblum & Bernstein

[57] ABSTRACT

An inside contamination preventing mechanism is provided that is adapted to be positioned in an imaging apparatus utilizing an electrophotographic system for forming an image on a predetermined recording medium and having an air directing mechanism including an air intake portion through which air flows from the outside of the imaging apparatus and a driving member for driving the air to a predetermined portion through a predetermined area within the imaging apparatus, and a toner containing member that is located adjacent to the air intake portion for containing the toner particles remaining in the imaging apparatus after an imaging operation onto the predetermined recording medium. The inside contamination preventing mechanism includes a cover member provided on an inner surface of the imaging apparatus for covering an opening of the toner containing member. Thus, it becomes possible to prevent the toner from floating in the air, and accordingly, it becomes possible to keep the inside of the imaging apparatus clean.

10 Claims, 6 Drawing Sheets

F. I G. 4

INSIDE CONTAMINATION PREVENTION STRUCTURE FOR A DEVICE UTILIZING TONER PARTICLES

BACKGROUND OF THE INVENTION

The present invention relates to an inside contamination prevention structure for an image formation apparatus utilizing a so-called electrophotographic system for preventing contamination inside the apparatus due to discharged toner leaking from an opening of a discharged toner container.

An image formation apparatus such as an electronic copy machine, a laser printer and the like which uses a so-called electrophotographic system is known, the image formation apparatus forming an electrostatic latent image by exposing a surface composed of a photoconductive material of a photoconductive drum which has been charged in advance with a predetermined polarity, developing the latent image by adhering toner particles on the photoconductive drum in accordance with the latent image, and transferring the toner image onto a recording medium and fixing a same at a fixing unit.

FIG. 1 shows a diagram of the schematic arrangement of a laser beam printer. A cleaning unit 2, a discharging unit, 3, a charging unit 4, scanning optical system 5 for introducing a laser beam having been modulated in accordance with an image information onto a photoconductive drum 1, as indicated by an arrow "A", a development unit 6, and a transfer unit 7 are disposed, respectively, around the photoconductive drum 1 in a rotational direction "B" thereof. Further, a fixing unit 8 is disposed at the downstream side of the photoconductive drum 1 along a feeding path of a continuous-form sheet 200.

As the photoconductive drum 1 is rotated in the "B" direction, the surface thereof is, first, evenly charged at the charging unit 4 with a predetermined polarity, and is scanned in a lengthwise direction thereof by the laser beam from the scanning optical system 5. As a result, a latent image corresponding to the image information to be developed is formed on the photoconductive drum 1. Toner is adhered to the latent image at the development unit 5 to make the latent image visible as a toner image, and the toner image is transferred onto the recording paper 200 being fed at the speed same as the circumferential speed of the photoconductive drum 1 being rotated at the transfer unit 7. The toner image transferred onto the recording paper 200 is heated and pressurized at the fixing unit 8. Thus the transferred toner image is fixed onto the recording paper 200.

The photoconductive drum 1 must be replaced each predetermined operation time as determined by the life of the photoconductive material thereof, and in many cases the photoconductive drum 1 is integrally arranged with the functional units, such as the cleaning unit 2, charging unit 4 and the like which also have a predetermined positional relationship with respect to the photoconductive drum 1, to thereby form a drum unit.

The cleaning unit 2 cleans the surface of the photoconductive drum 1 by magnetically or mechanically recovering toner particles remaining on the surface of the photoconductive drum 1 after the toner image has been transferred, and the toner recovered at the cleaning unit 2 is fed to the side of the drum unit in a predetermined manner, and recovered into a discharged toner container not shown.

The charging unit 4 usually charges the photoconductive drum 1 with a so-called corona discharge generated by a corona charger (not shown) since harmful ozone is generated by the corona discharge, the image formation apparatus utilizing an electrophotographic system is usually provided with a filter for absorbing the ozone and a fan for introducing air in the apparatus to the filter, so that the ozone is absorbed by the filter.

To effectively absorb the generated ozone by the filter the positional relationship between air intake ports and the fan is preferably set to enable air to flow along the charging unit, for this purpose, the air intake ports must be disposed at the upper portion of one end of the charging unit and the fan must be disposed at the other end of the charging unit, so that the air taken from the air intake ports flows along the charging unit.

However, when it is intended that the air intake ports are disposed at the upper portion of one end of the charging unit and the fan is disposed at the other end of the charging unit, as described above, the fan cannot help being disposed at the other end of the charging unit because the discharged toner container must be disposed at the one end of the charging unit. Thus the air intake ports must be defined on the discharged toner container side. In other words, air entering from the air intake port passes over the discharged toner container and then reaches the filter passing over the discharging unit.

As a result, a problem arises in that floating toner dust, leaking from the discharged toner container, flows into the apparatus together with air and contaminates the inside thereof.

This problem can be prevented by completely sealing the opening of the discharged toner container with a cover as an independent member. However, when discharged toner is to be removed, the mounting and dismounting operations of the cover is time consuming and there is a great possibility that the cover is left to be mounted or lost.

SUMMARY OF THE INVENTION

It is therefore an object of the present invention to provide an improved inside contamination prevention structure for a device utilizing toner particles by which the inside of the apparatus is prevented from being contaminated by floating toner dust leaking from a discharged toner container and flowing into the apparatus together with air.

For this purpose, according to the present invention, there is provided an inside contamination preventing mechanism adapted to be positioned in an imaging apparatus utilizing an electrophotographic system for forming an image on a predetermined recording medium and having an air directing mechanism comprising an air intake portion through which air is flowed from the outside of the imaging apparatus and a driving member for driving the flowed air to a predetermined portion through a predetermined area within the imaging apparatus, and a toner containing member adjacently located with the air intake portion for containing the toner particles remaining in the imaging apparatus after an imaging operation onto the predetermined recording medium;

the inside contamination preventing mechanism comprising a cover member provided on an inner surface of the imaging apparatus for covering an opening of the toner containing member.

DESCRIPTION OF THE ACCOMPANYING DRAWINGS

DESCRIPTION OF THE EMBODIMENTS

An embodiment of the present invention will be described hereinafter with reference to FIGS. 2–6 of the drawings.

Figure 1:
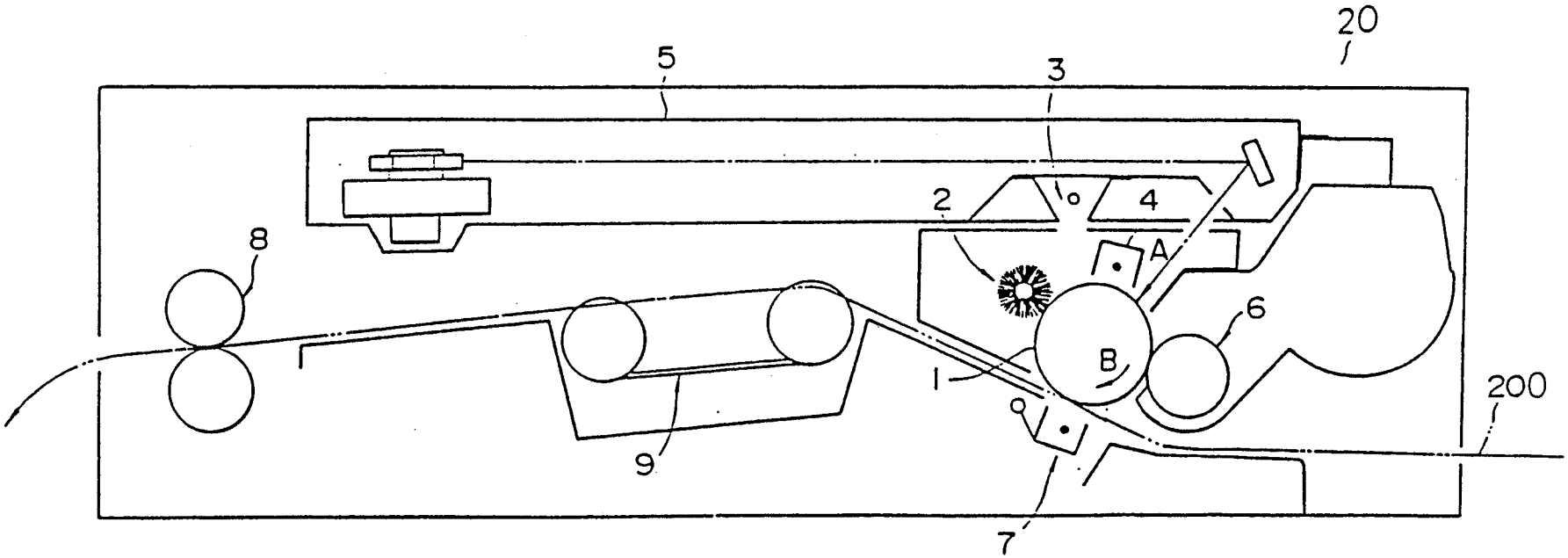
FIG. 1 is a schematic arrangement of a laser beam printer to which an inside contamination prevention structure according to the present invention is employable.
Figure 2:
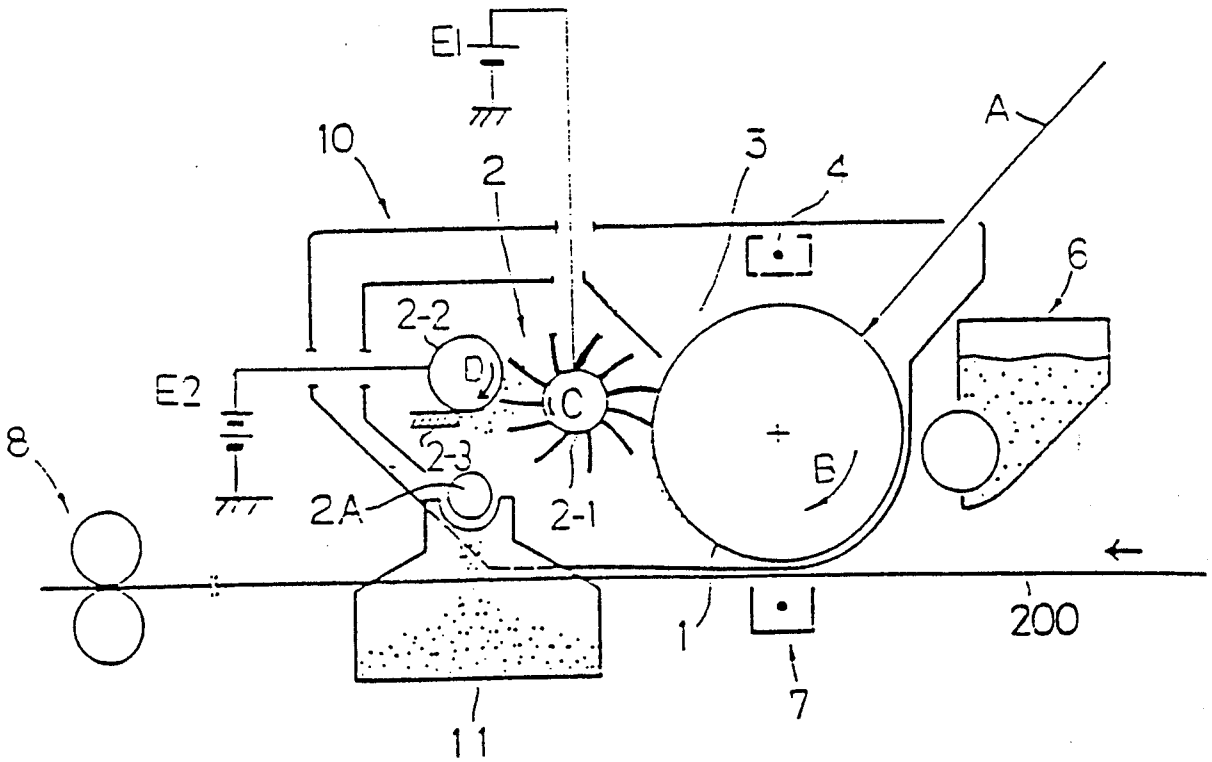
FIG. 2 is a partial schematic arrangement of the laser beam printer shown in FIG. 1.
Figure 3:
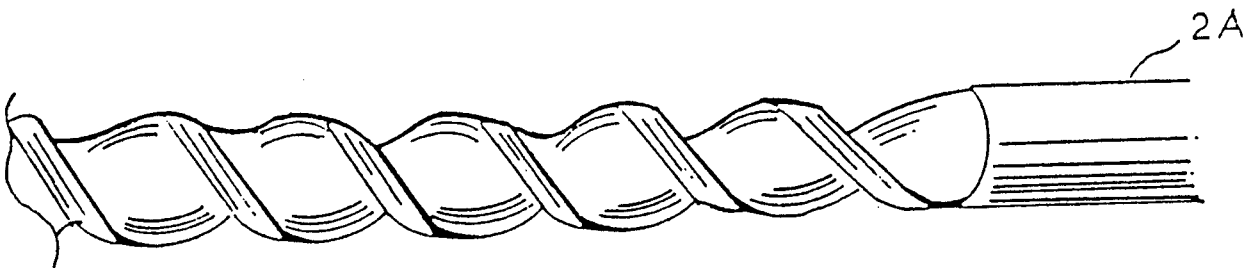
FIG. 3 is a side view of an auger screw to be employed for feeding remaining toner particles.

FIG. 2 is a partial sectional view of a principal part of the laser beam printer to which a structure according to the present invention can be employed. The same numbers are referred to the same element of the laser beam printer shown in FIG. 1. A drum unit 10 includes the photoconductive drum 1 and the cleaning unit 2. As shown in FIG. 2, the cleaning unit 2 comprises a brush member 2-1 whose wires are arranged to be contacted with the photoconductive drum 1 and which rotate in a direction indicated by arrow "C". Usually, the toner particles are negatively charged and the wires of the brush 2-1 are charged with the opposite polarity, i.e., positive, in a predetermined value, for example, E1(V). Accordingly, the toner particles, having been undesirably remained on the photoconductive drum 1 after the transfer operation at the transfer unit 7, are attracted to the brush 2-1. Thus the surface of the photoconductive drum 1 is cleaned. In the cleaning unit 2, a toner collection roller 2-2, arranged to be rotated in a direction indicated by arrow "D" and to be contacted with the wires of the brush 2-1, is provided. The toner collection roller 2-2 is charged with the same polarity as the brush 2-1 for example, E2(V). The value "E2" is arranged to be larger than the value "E1". Therefore, the toner particles having been attracted by the brush 2-1 are further attracted by the toner collection roller 2-2. The toner particles on the toner collection roller 2-2 are repelled by a blade 2-3 as the toner collection roller 2-2. Further, the toner particles are fed by a screw-shaped rotary shaft 2A, such as an auger screw, as shown in FIG. 3, toward the outside of the drum unit 10, and collected into a discharged toner container 11.

Figure 4:
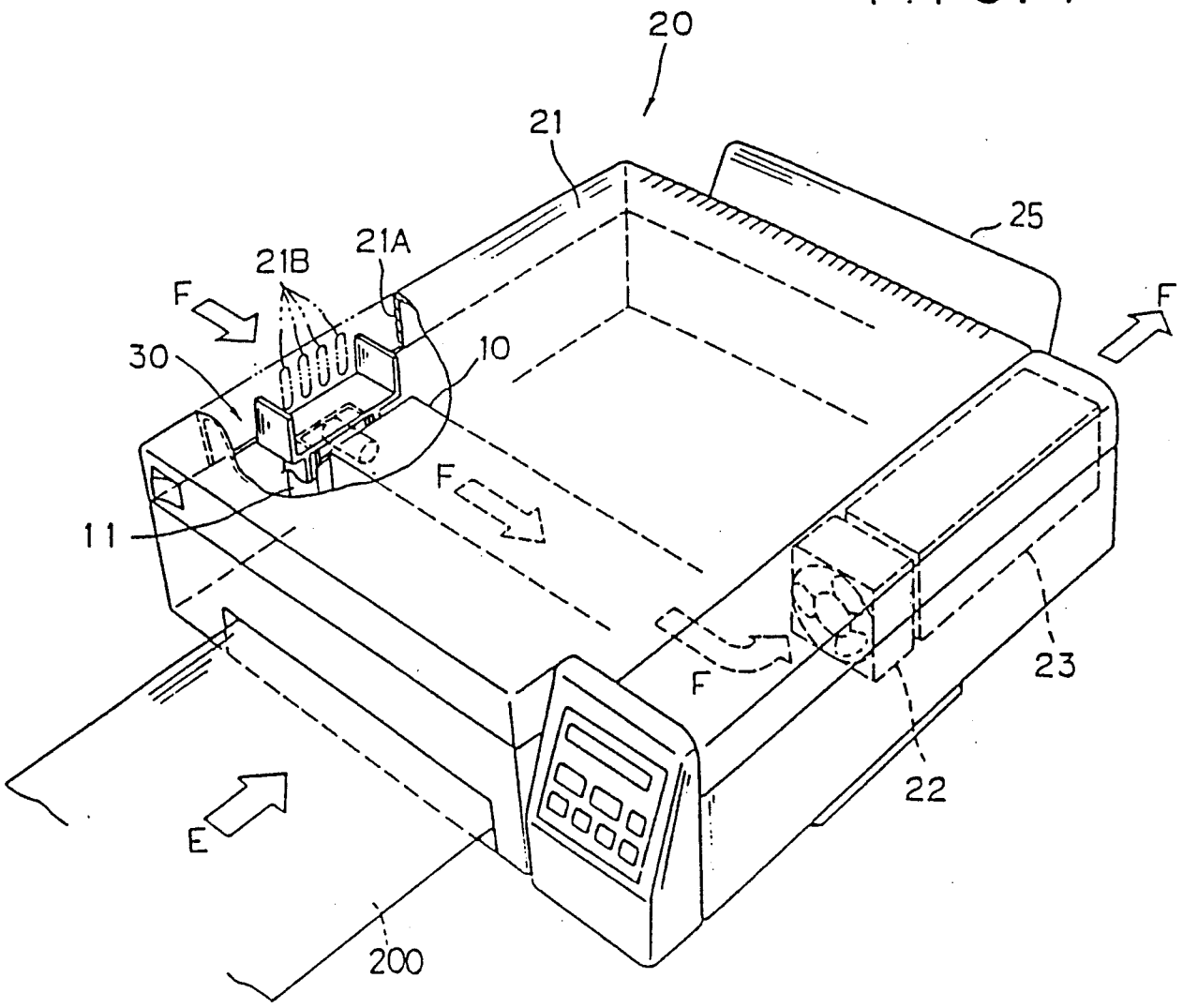
FIG. 4 is a perspective view of the laser beam printer in which the inside contamination prevention structure is provided.

FIG. 4 is a perspective view of a laser beam printer apparatus including the drum unit 10 shown in FIG. 2.

The illustrated laser beam printer apparatus 20 prints character and/or symbol data outputted from an external device, not shown, such as a computer, a word processor and the like an, further, outputs figures based on image data read by an image reader (not shown), and transfers images at the drum unit 10 including a photoconductive drum onto a continuous paper 200 as a recording paper fed from a feed port as indicated by arrow "E". At the paper discharge side of the printer 20, a sheet receiving tray 25 is disposed.

A clam shell 21 that serves as an upper portion of the laser beam printer apparatus 20, can be opened upward about a fulcrum (not shown) provided at an edge of a paper discharge side, i.e., an upper right side in FIG. 4 so that the continuous paper 200 is mounted. Further, maintenance operations of the laser beam printer apparatus 20 is carried out when the clam shell 21 is opened.

Figure 5:
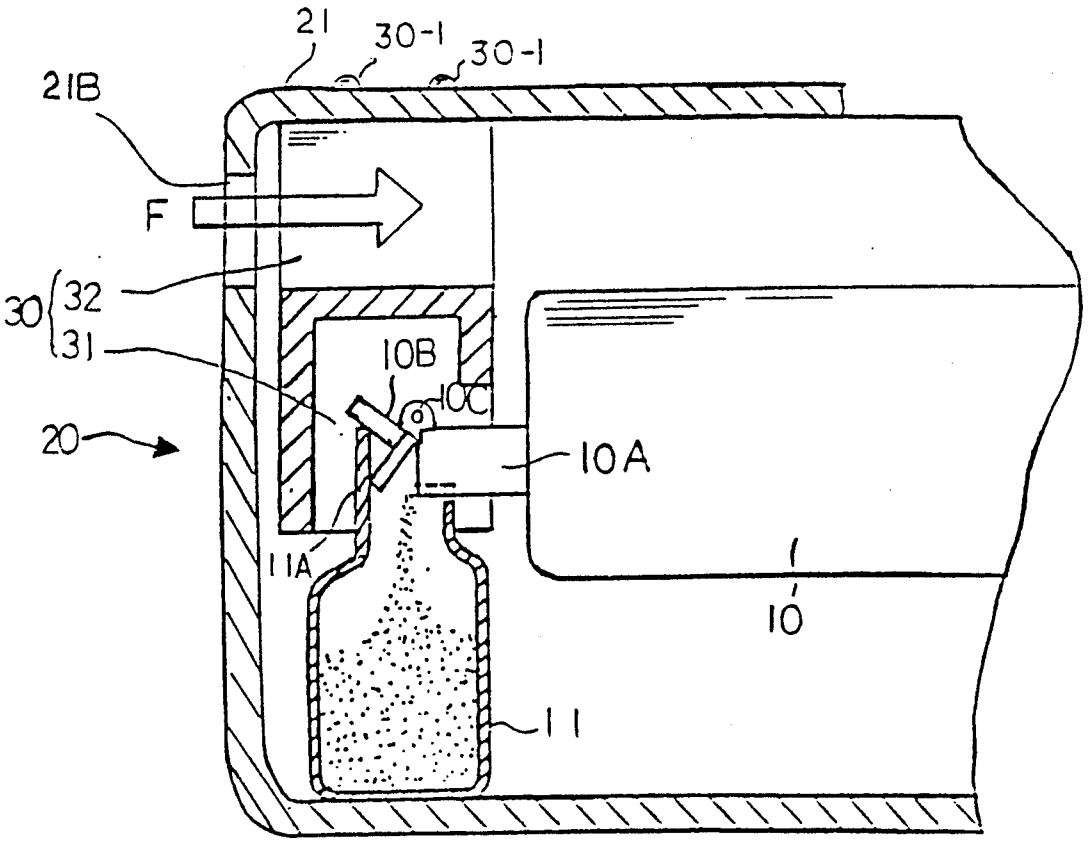
FIG. 5 is a partial cross-sectional view of the laser beam printer shown in FIG. 4.

The discharged toner container 11 is disposed at one side of the drum unit 10, as shown in FIG. 5 as the enlarged cross-sectional view thereof and discharged toner which has been subjected to cleaning by a cleaning unit (frist occurrence) not shown accommodated within the drum unit 10 is discharged into the discharged toner container 11 through a discharge port 10A. The discharge port 10A is arranged in a tube-shaped manner and a toner feeding member such as the auger screw shown in FIG. 3, is inserted within the discharge port 10A. As the auger screw 2A is rotated, the toner particles are fed towards the outside of the discharge port 10. The discharge port 10A is provided with a cover 10B which is arranged to be rocked about a rocking shaft 10C. The cover 10B is biased counterclockwise in the drawing of FIG. 5 by a biasing member (not shown) such as a torsion spring. In other words, the discharge port 10A is usually covered by the cover 10B.

When the toner particles are to be collected into the toner container 11, the cover 10B is opened and an outer wall 11A of the discharged toner container 11 is located within a rocking area of the cover 10B. In other words, the cover 10B is prevented from being rocked and the discharge port 10A is opened.

Further, as shown in FIG. 4, a fan 22 is disposed at one side of the drum unit 10 and a filter 23 for absorbing ozone is disposed in front of an air flow formed by the fan 22.

A plurality of air intake ports 21B are disposed to the side plate 21A of the clam shell 21 at the outside of the discharge toner container 11. When the fan 22 is driven to rotate, air entering from the air intake ports 21B flow along the drum unit 10 on the upper surface side thereof and is discharged to the outside of the apparatus 20 through the filter 23, as shown by arrows "F". Although only the drum unit 10, fan 22 and filter 23 are shown in the figure, respective functional units needed to form an image on the continuous paper 200 by an electrophotographic system are disposed in the other portions.

The clam shell 21 is provided with a cover member 30 that also serves as an air flow guide.

Figure 6:
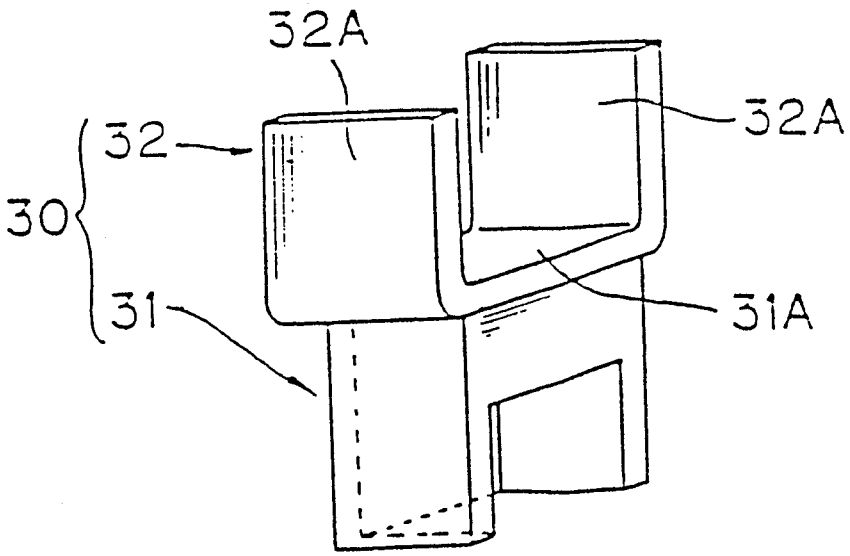
FIG. 6 is a perspective view of a cover member that also serves as an air flow guide employed in the inside contamination prevention structure according to the present invention.

As shown in FIG. 6, the cover member 30 also serve as the air flow guide and is composed of an integrally formed cover portion 31 which covers the discharged toner container 11 an and air flow guide portion 32, the air flow guide portion 32 being arranged such that an upper surface 31A of the cover portion 31 is projected in the side directions thereof by a predetermined amount and wall surfaces 32A, 32A are vertically provided on opposite ends thereof. The upper surface 31A of the cover portion 31 of the air flow guide portion 32 and the wall surfaces 32A, 32A are fixed on the inner upper surface of the clam shell 21 such that they surround the air intake ports 21B in a predetermined manner, such as a pair of screws 30-1, 30-1 (FIG. 5). Thus, when the clam shell 21 is closed, the cover portion 31 is placed on the upper opening of the discharged toner container 11 and the toner discharge port 10A of the drum unit 10 and the upper surface of the cover portion connects the inside surface of the side plate to the upper surface of the drum unit 10.

With the above-described arrangement, air entering through the air intake ports 21B by driving the fan 22 is guided by the air flow guide portion 32 of the cover member 30 that also serves as the air flow guide and flows along the drum unit 10 over the upper surface side thereof. At this time, the upper opening of the discharged toner container 11 is covered by the cover portion 31 of the cover member 30, which also serves as the air flow guide. Thus discharged toner dust does not float from the discharged toner container 11 and discharged toner dust does not mix into the apparatus with the air entering from the air intake ports 21B. Further, when the clam shell 21 is opened to carry out maintenance and the like, the cover portion 31 of the cover member 30, serving as the air flow guide 2 is removed from the upper portion of the discharged toner container 11 by opening the clam shell 21, so that the discharged toner container 11 can be easily detached.

In the above embodiment, although the cover member 30 which also serves as the air flow guide 1 is arranged as an independent member and attached to the clam shell 21, it may be of course unitarily formed with the clam shell 21.

As described above, according to the inside contamination prevention structure of the present invention since the flow of air entering from the air intake ports is guided by the guide portion and the opening of the discharged toner container is covered by the cover portion, toner dust does not leak from the discharged toner container and float and the toner dust does not flow into the apparatus with an air flow, so that the inside of the apparatus is prevented from being contaminated by the toner dust.

The present disclosure relates to subject matter contained in Japanese Utility model application No. HEI 02-38268(filed on Apr. 10, 1990) which is expressly incorporated herein by reference in its entirety.

What is claimed is:

1. An inside contamination preventing mechanism that is adapted to be positioned in an imaging apparatus utilizing an electrophotographic system for forming an image on a predetermined recording medium and having an air directing mechanism comprising an air intake portion through which air flows from an outside of said imaging apparatus and a driving member for driving said flowing air to a predetermined portion through a predetermined area within said imaging apparatus, and a toner containing member that is located adjacent said air intake portion for containing toner particles that remain in said imaging apparatus after an imaging operation is performed on said predetermined recording medium;

said inside contamination preventing mechanism comprising a cover member that is arranged to guide said flowing air to said predetermined area and is provided on an inner surface of said imaging apparatus to cover an opening of said toner containing member so as to inhibit a communication between said air intake portion and said opening of said toner containing member, while allowing an inflow of said remaining toner particles through said opening, said cover member comprising a pair of wall portions that extend upwardly from an upper portion thereof, said pair of wall portions being arranged in such a manner that air from said air intake portion flows between said pair of wall portions.

2. An inside contamination preventing mechanism that is adapted to be positioned in an imaging apparatus utilizing an electrophotographic system for forming an image on a predetermined recording medium and having an air directing mechanism an air intake portion through which air flows from an outside of said imaging apparatus and a driving member for driving said flowing air to a predetermined portion through a predetermined area within said imaging apparatus, and a toner containing member that is located adjacent said air intake portion for containing toner particles that remain in said imaging apparatus after an imaging operation is performed on said predetermined recording medium;

said inside contamination preventing mechanism comprising a cover member that is provided on an inner surface of said imaging apparatus to cover an opening of said toner containing member so as to inhibit a communication between said air intake portion and said opening of said toner containing member, while allowing an inflow of said remaining toner particles through said opening, a drum unit including a photoconductive drum on which a latent image is formed and a transfer unit on which said toner particles are distributed in accordance with a latent image being located at said predetermined area, and a filter for absorbing ozone generated at said transfer unit being provided at said predetermined portion.

3. An inside contamination preventing mechanism that is adapted to be positioned in an imaging apparatus that utilizes an electrophotographic system for forming an image on a predetermined recording medium and having an air directing mechanism comprising an air intake portion through which air flows from an outside of said imaging apparatus and a driving member for driving said air to a predetermined portion through a predetermined area within said imaging apparatus, and a toner containing member located adjacent with said air intake portion for containing toner particles that remain in said imaging apparatus after an imaging operation onto said predetermined recording medium;

said inside contamination preventing mechanism comprising a cover member, provided on an inner surface of said imaging apparatus, including a cover portion for covering an opening of said toner containing member and a pair of wall portions that extend upward from said cover portion, said pair of wall portions being arranged in such a manner that said air from said air intake portion flows between said pair of wall portions.

4. An imaging apparatus utilizing an electrophotographic system for forming an image on a predetermined recording medium, comprising:

a housing;

a photoconductive drum that is disposed in said housing and on which a latent image is formed;

means for charging an outer circumferential surface of said photoconductive drum;

an air path that is provided in said housing, such that fresh air from outside of said housing flows through at least an area where said charging means is disposed, said air path being defined between an air intake port formed to one side of said housing and an air discharge port formed to another side of said housing;

means for conducting said air in said air path to said outside of said housing;

a toner containing member having an opening that is disposed near said air path, such that toner particles that are removed from said photoconductive drum flow therein; and a cover member for inhibiting a communication between said air path and said opening of said toner containing member, while allowing an inflow of said removed toner particles through said opening, said housing being divided into an upper housing part to which said air intake port and said air discharge port are formed, and a lower housing part in which said photoconductive drum is arranged.

5. The apparatus of claim 4, wherein said cover member is attached to said upper housing.

6. The apparatus of claim 4, wherein said upper housing part is pivotally supported to said lower housing part between a closed position, in which said upper housing part is joined to said lower housing part, and an open position, in which said upper housing part is rotated and an open end thereof is removed from said lower housing part.

7. The apparatus of claim 6, wherein said cover member is set to a position where it is arranged above said opening of said toner containing member when said upper housing part is rotated to said closed position.

8. An inside contamination preventing mechanism that is adapted to be positioned in an imaging apparatus that utilizes an electrophotographic system for forming an image on a predetermined recording medium, said imaging apparatus having an air intake portion through which air flows from an outside of said imaging apparatus, and a driving member for driving said flowing air to a predetermined portion through a predetermined area within said imaging apparatus, and a toner containing member that is located adjacent to said air intake portion for containing toner particles that remain in said imaging apparatus after an imaging operation is performed on said predetermined recording medium, said inside contamination preventing mechanism comprising:

a cover member that is provided on an inner surface of said imaging apparatus for covering an opening of said toner containing member, said cover member having a pair of wall portions that extend upwardly from an upper portion thereof, said pair of wall portions being arranged in such a manner that air from said air intake portion flows between said pair of wall portions to said predetermined area.

9. The inside contamination preventing mechanism of claim 8, wherein a drum unit includes a photoconductive drum on which a latent image is formed and a transfer unit on which said toner particles are distributed in accordance with said latent image, said drum unit being located at said predetermined area, and a filter for absorbing ozone that is generated at said transfer unit, said filter being provided at said predetermined portion.

10. The inside contamination preventing mechanism of claim 8, wherein said cover member inhibits a communication between said air path and an opening of said toner containing member, while allowing an inflow of removed toner particles through said opening.

* * * * *

UNITED STATES PATENT AND TRADEMARK OFFICE

CERTIFICATE OF CORRECTION

PATENT NO. : 5,189,473

DATED : February 23, 1993

INVENTOR(S) : I. NEGORO et al.

It is certified that error appears in the above-indentified patent and that said Letters Patent is hereby corrected as shown below:

At column 6, line 8 (claim 2, line 5) of the printed patent, insert ---comprising--- after "mechanism".

Signed and Sealed this

Eighth Day of November, 1994

Bruce Lehman

*Attest:*

BRUCE LEHMAN

*Attesting Officer*

*Commissioner of Patents and Trademarks*